US010192711B2

(12) United States Patent
Bondarenko et al.

(10) Patent No.: US 10,192,711 B2
(45) Date of Patent: Jan. 29, 2019

(54) FLUID INJECTOR FOR X-RAY TUBES AND METHOD TO PROVIDE A LIQUID ANODE BY LIQUID METAL INJECTION

(71) Applicant: Siemens Aktiengesellschaft, Munich (DE)

(72) Inventors: Taras Bondarenko, Drozhzhino (RU); Alexandra Botyachkova, Sarov (RU); Gennadiy Karpinskiy, Desnogorsk (RU); Stepan Polikhov, Ramenskoye (RU)

(73) Assignee: Siemens Aktiengesellschaft, Munich (DE)

( * ) Notice: Subject to any disclaimer, the term of this patent is extended or adjusted under 35 U.S.C. 154(b) by 195 days.

(21) Appl. No.: 15/326,162

(22) PCT Filed: Jul. 17, 2014

(86) PCT No.: PCT/RU2014/000522

§ 371 (c)(1),
(2) Date: Jan. 13, 2017

(87) PCT Pub. No.: WO2016/010448

PCT Pub. Date: Jan. 21, 2016

(65) Prior Publication Data

US 2017/0221670 A1 Aug. 3, 2017

(51) Int. Cl.

| | |
|---|---|
| ***H01J 35/00*** | (2006.01) |
| ***H01J 35/08*** | (2006.01) |
| ***B05B 1/08*** | (2006.01) |
| ***B05B 17/00*** | (2006.01) |
| ***B05B 17/06*** | (2006.01) |

(52) U.S. Cl.
CPC ..... *H01J 35/08* (2013.01); *B05B 1/086* (2013.01); *B05B 17/0646* (2013.01); *B05B 17/0669* (2013.01); *H01J 2235/082* (2013.01)

(58) Field of Classification Search
CPC ..... H01J 2235/082
See application file for complete search history.

(56) References Cited

U.S. PATENT DOCUMENTS

| | | | |
|---|---|---|---|
| 3,836,805 | A | 9/1974 | Kok |
| 6,735,283 | B2 | 5/2004 | Kutschera et al. |

(Continued)

FOREIGN PATENT DOCUMENTS

| | | |
|---|---|---|
| CN | 1466860 | 1/2004 |
| CN | 102369587 | 3/2012 |

(Continued)

*Primary Examiner* — Dani Fox
(74) *Attorney, Agent, or Firm* — Cozen O'Connor

(57) ABSTRACT

A fluid injector for x-ray tubes and a method to provide a liquid anode by liquid metal injection, wherein the fluid injector includes a device to inject fluid from an opening in a chamber of the device as a fluid jet generated by an arrangement to change the volume within the chamber, and includes a reservoir to store the anode material, which is fluidically connected by a pipe with the chamber of the device, where the pipe has a part formed in the fluid flow direction that is shaped to block fluid flow from the chamber to the reservoir during injection, and where the includes injecting fluid in a direction towards an electron beam and refilling the chamber with liquid metal from the reservoir.

22 Claims, 3 Drawing Sheets

(56) References Cited

U.S. PATENT DOCUMENTS

| | | | | |
|---|---|---|---|---|
| 7,412,032 | B2 | 8/2008 | Harding | |
| 7,929,667 | B1 | 4/2011 | Zhuang et al. | |
| 8,170,179 | B2 | 5/2012 | Hertz et al. | |
| 2002/0015473 | A1* | 2/2002 | Hertz | H01J 35/08 378/143 |
| 2006/0017026 | A1 | 1/2006 | Hergenhan et al. | |
| 2011/0317818 | A1* | 12/2011 | Hertz | G21K 1/02 378/140 |

FOREIGN PATENT DOCUMENTS

| | | | |
|---|---|---|---|
| DE | 3429799 | A1 | 2/1986 |
| DE | 10130070 | | 1/2003 |
| WO | WO 2005/096341 | | 10/2005 |
| WO | WO 2010/112048 | | 10/2010 |

* cited by examiner

FLUID INJECTOR FOR X-RAY TUBES AND METHOD TO PROVIDE A LIQUID ANODE BY LIQUID METAL INJECTION

CROSS-REFERENCE TO RELATED APPLICATIONS

This is a U.S. national stage of application No. PCT/RU2014/000522 filed 17 Jul. 2014.

BACKGROUND OF THE INVENTION

1. Field of the Invention

The present invention relates to a fluid injector for x-ray tubes and a method to provide a liquid anode by liquid metal injection, with a device to inject fluid from an opening in a chamber of the device as a fluid jet generated by an arrangement to change the volume within the chamber, and comprising a reservoir to store the anode material, which is fluidically connected by a pipe with the chamber of the device.

2. Description of the Related Art

X-rays are used, for example, in clinical diagnostics and visualization. Usually, x-rays are generated by applying a high voltage to an x-ray tube. The x-ray tube is a capsulated device comprising vacuum and with an electron source, i.e., cathode as well with an electron target, i.e., anode.

Electrons emitted from the cathode are accelerated by an applied high voltage between anode and cathode, and hit the anode at a high velocity, i.e., energy. A high thermal load is generated at the anode material of the x-ray tube as an impact of the electron beam.

The interaction of electrons with anode material is accompanied by radiation, the so called "Bremsstrahlung" with a continuous spectrum and the "Characteristic" radiation with a discrete monochromatic spectrum. The "Bremsstrahlung" radiation spectrum is inefficient for various diagnostic applications in healthcare. Only some portion of the "Bremsstrahlung" radiation spectrum is used for quality imaging, while low energy photons overexpose the patient without contribution to the image quality. More than 99% of electron energy is converted into heat in the anode material, leading to a high amount of thermal load at the target material. This is especially the case when the x-ray focal spot is in the range of micrometers in diameter, to obtain high resolution x-ray images.

To reduce the thermal load at the anode, the target material can be changed rapidly in order not to accumulate the thermal load in a specific volume part of the target material. The most effective ways to provide rapidly changing anode material facing the electron beam are the use of rotating or moving solid state anodes, and another way is the use of a target formed by a flowing liquid material, such as a high Z material or a combination of a low and high Z material.

U.S. Pat. No. 3,836,805A, DE 3 429 799A1 and U.S. Pat. No. 6,735,283B2 disclose conventional x-ray cubes with rotating anodes are known from the state of the art. The limiting factor in the described arrangements is the maximum of rotational frequency, which is sensible to external acceleration for example of the whole tube, and it is difficult to fabricate tubes with a reliable transmission microfocus source.

U.S. Pat. No. 8,170,179B2, U.S. Pat. No. 7,929,667B1 and U.S. Pat. No. 7,412,032B2 also disclose conventional x-ray tubes with liquid metal in form of a jet used as anode are also known from the state of the art. The advantages of a liquid jet as a target material are the excellent heat transfer properties of liquid metals and the possibility to generate thin and fast liquid jets flowing free in vacuum or inside an electron- and x-ray transparent casing, such as with a jet with less than 0.1 mm diameter and more than 50 m/s velocity of the liquid flow. The disadvantage of the described arrangements is the use of complex recirculation systems, comprising pumps for high temperature liquid metal. The flow rate of liquid metal is limited by the pumps, the reliability of the arrangement is limited and pumps increase costs and complexity.

SUMMARY OF THE INVENTION

It is an object of the present invention to provide a fluid injector for x-ray tubes and a method to provide a liquid anode by liquid metal injection solving the above described problems. Particularly, it is an object of the invention to provide an injector and a method to use the injector to produce x-rays, preventing high thermal loads, without moving parts such as valves, with a simple and easy to use configuration, with low complexity and long lasting without substantial wear, and which has a cost-effective production.

These and other objects and advantages are achieved in accordance with the invention by a fluid injector for x-ray tubes and a method to provide a liquid anode in which the fluid injector for x-ray tubes to provide a liquid anode by liquid metal injection in accordance with the present invention comprises a device to inject fluid from an opening in a chamber of the device as a fluid jet, generated by an arrangement to change the volume within the chamber. The fluid injector further comprises a reservoir to store the anode material, which is fluidically connected by a pipe with the chamber. The pipe comprises a part formed in the fluid flow direction with a shape to block fluid flow from the chamber to the reservoir during injection. The described fluid injector in accordance with the present invention solves the above described problems. Particularly, the fluid injector provides a liquid anode by liquid metal injection to an x-ray tube for the generation of x-rays, which prevents high thermal loads. The injector has a simple and easy to use configuration, with low complexity. The described injector is long lasting without substantial wear, and cost-effective in its production due to no moving parts with high wear, such as pumps or valves. The configuration of the injector without valves and pumps allows its use with a high frequency of injection. The injector is reliable and due to the fast change of anode material in contact with an electron beam, the summing up of thermal load is reduced in the material. X-rays can be produced with high intensity and focused, without a high level of effort.

The part of the pipe with a shape to block fluid flow from the chamber to the reservoir during injection can be formed in the fluid flow direction with a curved and/or angled shape, particularly as repeated loops of the pipe, particularly in spiral form.

This form is easy and cost-effective to produce, especially with commercially available pipe material, and is effective in blocking fluid flow from the chamber to the reservoir during injection, particularly short injection phases with high frequency alternating to refilling phases. The fluidic connection between the chamber and the reservoir can be an uninterrupted direct connection through the pipe and/or permanent. That is, there are no valves or other fluidically disrupting components arranged in the fluidic connection between the chamber and the reservoir. A pipe with a curved and/or angled shape without moving parts such as valves is easy to use, cheap to produce, and reliable, without high complexity, and is long lasting due to no moving parts, which reduces wear. The pipe can comprise a part having a spiral shape with a number of full loops in the range of 5 to 15 and/or a predefined radius of curvature and cross-section to result in a limited and/or turbulent fluid flow in a direction toward the reservoir in a phase of injection and to a laminar fluid flow in direction to the chamber during a refilling phase. The repeated loops are quite able to block fluid flow back to the reservoir during injection, even when fluid would flow with high velocity in a pipe without loops.

Turbulent flow is blocking fluid from flowing back to the reservoir from the injector chamber during injection. A laminar flow allows a good refilling of the chamber with fluid from the reservoir due to a good flow of fluid from the reservoir to the device with the chamber. A number of loops between 5 to 15 is high enough to block fluid flow during injection and low enough to allow a good fluid flow within the pipe during refilling without high resistance to the fluid flow. Depending among others on the kind of fluid used, the dimensions of the device to inject fluid and of the reservoir, the material of the pipe, the cross-section and radius of curvature as well as the number of loops needed to block fluid flow during injection can be calculated and pre-determined. The fluid can be and/or can comprise a liquid metal, particularly Gallium and/or a Gallium alloy and/or Lithium and/or a Lithium alloy. These materials are particularly suitable as anode materials for x-ray generation. The device can be configured for high pressure pulsed fluid injection, particularly with an injection frequency in the range of 10 to 1000 Hz. At this frequency, the use of valves is difficult to handle and involves a high amount of wear. The curved and/or angled shape part in the pipe is particularly able to block fluid flow during injection due to a hydraulic hammer effect.

The arrangement to change the volume within the chamber can comprise a metal sheet, a membrane and/or a piezo element for a volume change within the chamber, particularly with a frequency in the range of 10 to 1000 Hz and/or to produce a high pressure within the chamber for pulsed fluid injection through the opening. The device to inject fluid can comprise a nozzle cup, particularly with a sharp edge orifice, and/or a clamped circular membrane, and/or a piston particularly driven by a piezo-actuator. Such a configuration of the device enables the injection of a jet of anode material with a small cross section at high frequencies.

The injector and/or components of the injector, particularly the opening, can be arrangeable in or fluidically connectable to the inner part of a vacuum tube, to inject fluid as anode material into and/or to an electron beam, particularly generated by an electron source. The method to provide a liquid anode by liquid metal injection in an x-ray tube in accordance with the present invention, particularly using a fluid injector as described before, comprises a step of injecting liquid metal as a fluid jet from an opening of a chamber comprised of a device to inject fluid in the direction towards an electron beam. The injection is generated by changing the volume of the chamber with an arrangement producing a high pressure in the fluid in the chamber. The method further comprises a step of refilling the chamber with liquid metal from a reservoir, where the liquid metal flow from the reservoir to the chamber through a pipe.

The liquid metal flow in the pipe can be laminar during refilling and at least partly turbulent during injection, particularly with liquid metal flow in the pipe limited by a part of the pipe with a curved and/or angled shape in the flow direction during injection. The curved and/or angled shape can take the form of repeated loops of the pipe, particularly in spiral form, i.e., formed as a spiral.

A pulsed liquid metal injection, particularly with a frequency of injection pulses in the range of 10 to 1000 Hz, can be followed in time by refilling the chamber with liquid metal from the reservoir, particularly the metal liquidized by heating up solid metal in the reservoir. The metal can be liquidized according to the amount needed for liquid injection. The electron beam can converge at the injected liquid metal jet, particularly pulsed liquid metal jet, in an angle of substantially 90 degree. Electrons hitting the liquid metal, i.e., anode target material yield energy to the material resulting in thermal load and x-ray generation. Due to the movement of material the target material hit by the electron beam is changing, preventing respectively reducing the summing up of the thermal load in a specific volume element of material. An angle of substantially 90 degrees of electron beam impact to the liquid metal let can results in a high x-ray yield, particularly in the transmission mode. Depending on the energy distribution, geometrical restrictions and other circumstances, other angles of coincidence are also possible. The electron beam can converge at the injected liquid metal jet, where the liquid metal acts as an anode material and/or target, and x-rays are generated. Particularly, the electron beam hits the target with high intensity in a small volume of metal and/or with low thermal load at the injected metal.

During injection, a piston driven by a piezo-actuator can produce high pressure in the chamber by compressing a hydraulic fluid, volume, deforming a membrane, particularly a clamped circular membrane, to reduce the volume of the chamber with liquid metal being ejected from the chamber through an opening, particularly as a nozzle cup with sharp edge orifice, and liquid metal being blocked from flowing to the reservoir by a part of the pipe with curved and/or angled shape.

The advantages in connection with the described method to provide a liquid anode by liquid metal injection in an x-ray tube in accordance with the present invention are similar to the previously, in connection with the fluid injector described advantages and vice versa.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The present invention is further described hereinafter reference to illustrated embodiments shown in the accompanying drawings, in which.

DETAILED DESCRIPTION OF THE EXEMPLARY EMBODIMENTS

Figure 1:
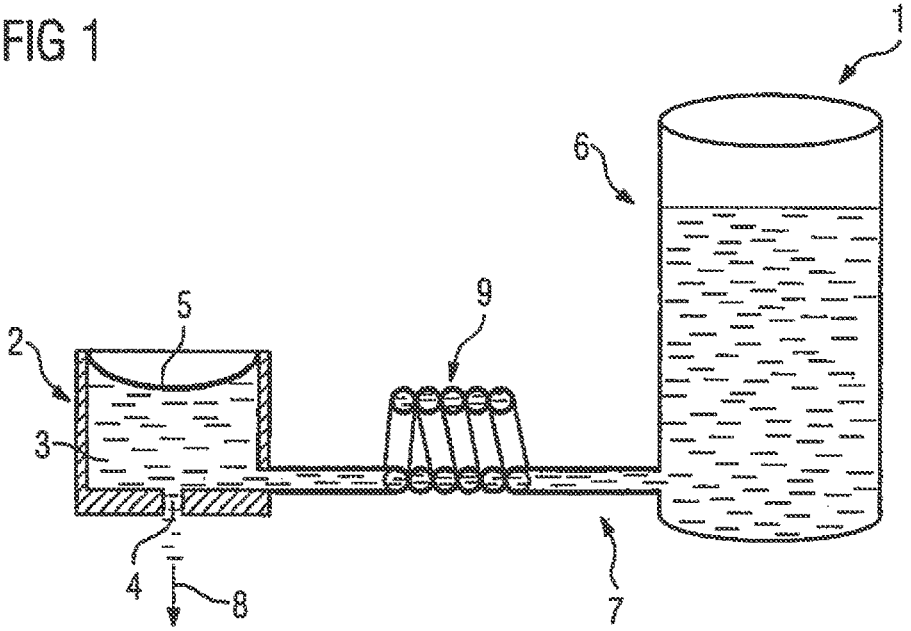
FIG. 1 illustrates a fluid injector in accordance with the present invention, with a pipe comprising a spiral part fluidically connecting a device to inject a fluid and a reservoir.

In FIG. 1 a fluid injector 1 in accordance with the present invention is shown, with a pipe comprising a spiral part 9 fluidically connecting a device 2 to inject a fluid and a reservoir 6. The spiral part 9 allows a laminar fluid flow during refilling of the device 2 with liquid from the reservoir 6, and blocks fluid flow from the device 2 to the reservoir 6 during injection of fluid from the injector 2.

The device 2 comprises a chamber 3 filled with fluid in liquid form to be injected. The volume of the chamber 3 is, for example, in the range of 1 $cm^3$. The fluid is a liquid metal that is used as an anode, such as a Gallium based alloy or a Lithium based alloy. Injected means ejected from the chamber 3 via an opening 4 in the chamber 3 to the outside of the chamber 3, i.e., the outside of the device 2. The device 2 comprises an arrangement 5 to change the volume within the chamber 3. The arrangement 5 can be or comprise, for example, a piezo-electric device, formed to reduce the volume of the chamber 3 particularly after applying a first electrical voltage. The volume reduction increases the pressure in the chamber 3 and a stream of liquid with a flow direction 8, as shown in FIG. 1, is ejected out of the chamber 3 through the opening 4. The liquid stream is injected when the surface tension of the liquid at the opening 4 is overcome. The injection leads to a reduction of pressure in the chamber 3 up to a point the pressure is below a value to overcome the surface tension, when the injection stops.

In a next step the arrangement 5, for example, the piezo-electric device can increase the volume of the chamber 3, for example, after applying a second electrical voltage, particularly with an opposite sign of the electrical voltage. The volume increase leads to a pressure reduction in the chamber 3. Liquid is sucked from the reservoir 6, which is filled with liquid, through the pipe 7 to the chamber 3 of the device 2. The chamber 3 is refilled with liquid metal and the process can re-start from the beginning, thus injecting liquid. As a result, a pulsed injection of liquid metal can be generated continuously or interrupted. Various periods of injection and refilling can be chosen according to the needs during application of the fluid injector 1. The injection and refilling can be periodical with the same time intervals or with changing time intervals. The pressure in the reservoir 6 is chosen to be low enough, such that the surface tension at the opening 4 is not overcome without moving parts of the arrangement 5. As long as the pressure in the reservoir 6 is below a limit, set by the diameter of opening 4 and liquid surface tension, no liquid leaves the fluid injector 1. The limit depends among others from the environment of the liquid injector 1, particularly the pressure, for example, in vacuum.

For a laminar liquid flow during refilling, which results in a liquid flow with low friction and a high refilling rate, the cross section of the pipe is larger than the cross section of the opening 4 in the chamber 3. With the circular diameter of the opening 4 D1 and pipe 7 D2, an example for an inner diameter of the pipe D2 is 200 Micrometer and a diameter of the opening 4 D1 is 50 Micrometer.

For the liquid flow to be blocked during injection, the time interval to refill is, for example, in the order of ten times longer than the time interval to inject. A short time interval to inject liquid, i.e., eject liquid from the chamber 3, results from a fast volume change by the arrangement 5, thus inducing a liquid flow pulse breaking through the opening 4 after overcoming the surface tension of the liquid and pushing liquid in the pipe 7 in the direction from the chamber 3 to the reservoir 6. The liquid pushed rapidly into the pipe 7 from the camber 3, particularly into the pipe with higher cross-section than the cross-section of the opening 4, results in a kind of hydraulic hawser and/or turbulent flow, which is blocked by the spiral part 9 of the pipe 7. In contrast, the more slow laminar flow during refilling is not or at least only very minimally reduced by the spiral part 9 of the pipe 7.

The number of windings of the spiral 9, the cross-section for fluid flow in the pipe 7 in relation to the cross-section of opening 4 and/or the volume of the chamber 3, particularly depending on the speed of volume change by the arrangement 5 and/or the time interval for refilling and injection, are calculated and/or predefined to get an injection of liquid from the device 2, particularly overcoming the surface tension of the liquid at opening 4, and to result in a blocking of liquid flow in the pipe 7 at the spiral part 9 during injection. The values, particularly the cross-section, i.e., inner cross-section of the pipe 7, the refilling time period and the number of windings of the spiral 9 are chosen to result during refilling in a laminar liquid flow to refill the chamber 3 from the reservoir 6 without or with little flow resistance and/or friction losses. A good refilling results from the described fluid injector 1 during refilling, with a high amount of injected liquid without and/or with little liquid flowing from the chamber 3 to the reservoir 6 during injection.

Figure 2:
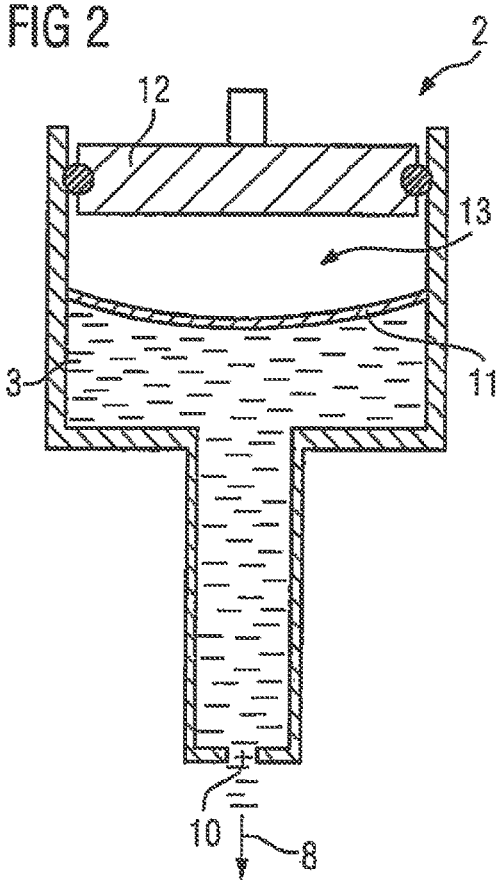
FIG. 2 shows an embodiment of the device of FIG. 1 in more detail with an opening formed as a nozzle cup with a sharp edged orifice.

FIG. 2 shows an embodiment of the device 2, with an opening 10 in the form of a nozzle cup with a sharp edged orifice. The arrangement 5 to change the volume within the chamber 3 comprises a hydraulic liquid volume 13, for example, filled with air, oil or water, enclosed by a clamped circular membrane 11, particularly steel membrane, and a piston driven by a piezo-actuator 12. Other parts such as the pipe 7 or reservoir 6 are not shown for reasons of simplicity. With a first voltage applied, for example, with a positive sign, the piezo-actuator drives the piston 12 down, in a direction toward the membrane 11. The hydraulic liquid volume is pushed in the direction toward the membrane 11, deforming the membrane 11 in the direction away from the piston 12. The chamber 3 with liquid to be injected by the injector is arranged opposite to the hydraulic liquid volume 13, separated by the membrane 11. The membrane 11 compresses the liquid to be injected in the chamber 3, which increases the pressure to a value above the fluid surface tension at the opening 10. Fluid breaks through and is ejected from the chamber 3, i.e., injected by the device 2.

With a second voltage applied to the piezo-actuator, for example, with a negative sign, the piston 12 moves up, in the direction away from the membrane 11. The hydraulic liquid volume is expanded, which deforms the membrane 11 towards the piston 12. The membrane 11 expands the liquid to be injected in the chamber 3, which decreases the pressure slowly to suck/extract liquid from the reservoir 6 via the pipe 7 to the chamber 3 without overcoming the surface tension of the liquid at the opening 10. No vacuum or air with low pressure is sucked into the chamber 3 via the opening 10. A slow movement of the membrane 11, i.e., slow expansion of the volume in chamber 3 and liquid sucking/extracting, results in a laminar liquid flow in the pipe 7 without blocking of the liquid by the spiral part 9. The chamber 3 is refilled with liquid from the reservoir 6, to be ready for the next injection. The process can be repeated as long liquid is in the reservoir 6, which can be refilled.

The refilling of chamber 3 can be actively, directly induced by the arrangement 5 with liquid flow synchronous with the movements of arrangement 5. In high frequency operation, the refilling can be slow over time after a fast movement of arrangement 5 induces a pressure difference between chamber 3 and reservoir 6.

With piezo-electric stacks, high frequency movements are possible, depending on the electric voltage change and its frequency. Typical expansion distances of piezo-electric stacks in the arrangement 5 are, for example, in the range of 0.1 mm, with a force in the range of 50 kN, creating pressure up to 500 to 1000 Atm. This allows high pressure injection in pulsed manner at high frequencies, such as 10 to 1000 Hz. At high voltage changes, a linear piezo-actuator is able to expand and/or contract with high frequency, pushing and/or pulling a piston 12 with high constant force. This force is converted to high pressure changes of, for example, a hydraulic liquid in a hydraulic liquid volume 13. A pressure difference between hydraulic liquid volume 13 and chamber 3 deforms, for example, a clamped disc membrane, particularly made of a thin steel sheet. The deformation induces high or low pressure in the chamber 3, inducing the liquid metal injection pulse respectively refilling.

The dimension of opening 10 in a chamber 3 is, for example, in the order of 0.01 to 0.1 mm and can be produced, for example, by laser drilling. The opening 10 can have conical shape with a cone base at the inner side of chamber 3, to provide a vena contracts flow. High injection pressure and small diameter of the opening 10 enable a high speed microjet.

The fluid injector 1 as shown in FIG. 1 allows a liquid metal flow, for example, liquid injection via opening 4 and refilling from reservoir 6, at a high frequency without the use of valves or moving parts to prevent air to be sucked into the chamber 3 during refilling and/or liquid to be pushed back into the reservoir 6 form chamber 3 during injection. The fluid injector 1 is less complex than with moving parts such as valves to block liquid flow, easier to produce, less expensive in production, and long lasting without wearable parts such as valves.

The change of direction of liquid flow in the pipe 7 part with curved and/or angled shape 9, with the pipe 7 being curved and/or angled shaped along the fluid flow direction, will cause significant hydraulic losses in addition to frictional losses occurring in the pipe 7 along the length of the pipe 7. These losses during the injection phase are orders of magnitude higher than during the refilling phase. This is caused by the fact that during injection the liquid outflow will be turbulent opposite to a laminar low speed refilling flow, i.e., charging of the chamber 3. A part of the pipe with the spiral shape 9 can be made, i.e., produced by spiraling a capillary tube with, for example, an inner diameter of 0.1 to 1 mm around a cylindrical rod with, for example, a diameter of 16 mm. A spiraled tube with 1 mm inner diameter and 2 mm outer diameter with 15×360 grad full turns will results in a pipe 7 with a length of approximately 0.85 m, and in 60×90 curved and/or angled shaped parts. Hydraulic losses in the curved and/or angled shape parts, which can also be called elbows and sum up to the spiral part 9, will give rise to additional 50% losses compared to pure frictional losses in the pipe 7, assuming high speed turbulent flow when the pressure difference between the device 2 and reservoir 6 is high, such as 100 Atm. During refilling, i.e., the charge phase, the curved and/or angled shape parts will not generate any additional losses due to the laminar regime of the liquid flow.

With pressure inside chamber 3 being increased very fast, the effect of the hydraulic hammer in the pipe 7 will appear, particularly in the spiral part 9 of the pipe 7. This effect originates from the fact that any disturbances in the liquid propagates through the liquid with a finite speed, which corresponds to the specific velocity of sound in the liquid, depending on physical and thermodynamics properties of the liquid and mechanical properties of the pipe 7. Due to the hydraulic hammer effect, a compression wave moves in direction from the device 2 to the reservoir 6, and an expansion wave moves in the reverse direction. Liquid is accelerated behind the front of the waves, taking a certain period of time to establish the outflow of the liquid to the reservoir 6. The propagation of shock waves in spiraled tubes is more complex than in straight tubes. This fact requires additional time to establish the outflow, minimizing total liquid losses during the injection and increasing a possible operating frequency.

This allows an operation of the device 2 in pulse mode, with a high frequency depending on the ratio of liquid loss during injection and compensation during refilling. Spiraled pipes 9 are easy to manufacture and limit the liquid outflow to the reservoir 7, i.e., storage tank, during the injection phase when the flow regime is turbulent, but do not bring any essential liquid flow losses during refilling when the flow regime is laminar.

Figure 3:
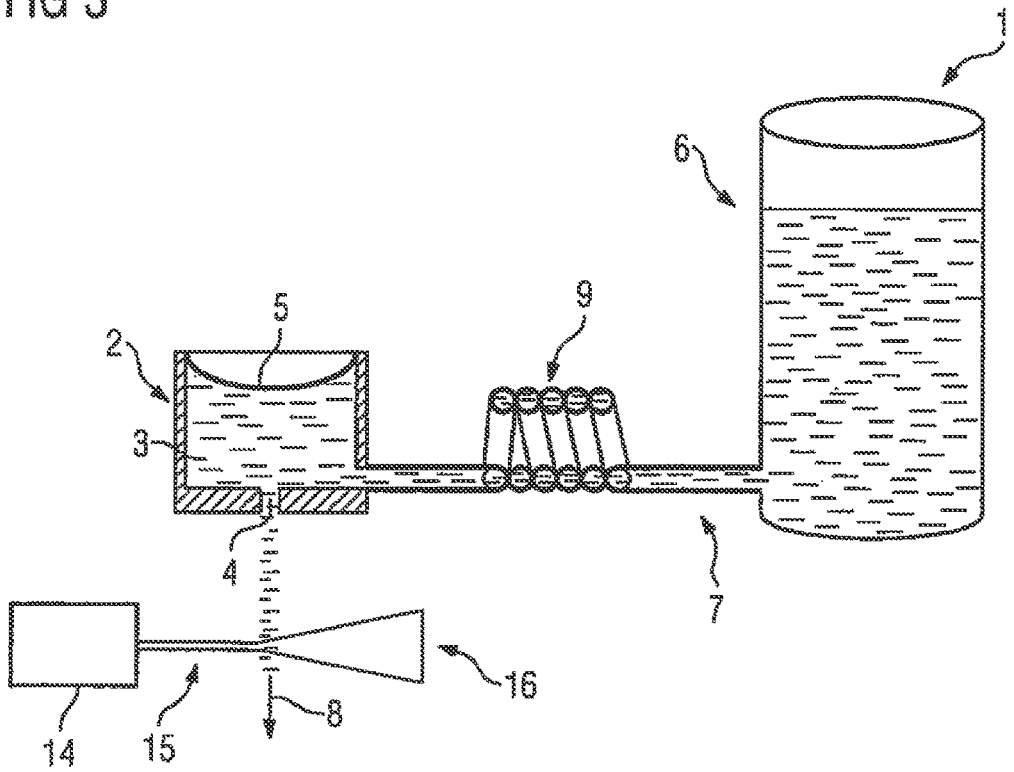
FIG. 3 shows the fluid injector of FIG. 1 arranged in an x-ray tube combined with an electron source, with generated electrons interacting with injected anode material to generate x-rays.

FIG. 3 shows the fluid injector 1, arranged in an x-ray tube combined with an electron source 14. The electron source 14 generates electrons 15, which interact with the injected anode material 8 to generate x-rays 16. The casing of the x-ray tube is not shown in FIG. 3 for simplicity reasons. The injection of liquid metal as anode material, for example, as a liquid high-speed jet 8, with injection into the electron beam 15 in the x-ray tube, provides an anode material well defined in shape and velocity. The anode material interacting with the electron beam 15 is fast changing, thus reducing the thermal load in the anode material volume in interaction with the electrons. The thermal load is distributed over the anode material. The electron beam 15 is generated by the electron source 14 and can be focused, striking the liquid anode material jet with flow direction 8 as shown in FIG. 3 in an angle of, for example, 90 degrees. X-rays are generated by the interaction of electrons with the anode material.

Due to reduced thermal load, less "Bremsstrahlung" and a higher specific x-ray radiation with well defined wave length can be produced. A well defined, specific wavelength of x-rays increases the resolution of, for example, x-ray computer tomographs or other x-ray examination devices.

To produce an x-ray image, just or only one anode material injection can be used for the imaging. The amount of anode material stored in reservoir 6 can last for a lifetime of an x-ray examination device. Alternatively, it can also be refilled. The fluid injector 1 in accordance with the present invention for x-ray tubes can be attached to the x-ray tube or arranged within the x-ray tube. The entire system can be part of an x-ray examination device, for example, built into the device. The compact set-up of the fluid injector 1, without moving parts such as valves, enables a set-up of an x-ray tube comprising the injector 1, with long lifetime.

The above described features of embodiments according to the present invention can be combined with each other and/or can be combined with embodiments known from the state of the art. For example, the dimension of components of the fluid injector 1 and frequencies for injection can be chosen according to the kind of liquid metal used as the anode material and according to the application of the x-ray tube. The membrane material can, for example, be instead of steel made of other metals and/or non metallic materials. The fluid injector 1 can be used in inert atmosphere instead of a vacuum, where the atmosphere influences the surface tension of the fluid and necessary dimensions of the opening 4, 10. The x-ray produced can be a microfocus x-ray. The liquid injector 1 can replace complex and bulky pump based recirculation systems, which are used for liquid metal injection. The operation mode of the liquid metal injector 1 can be pulsed mode, with a frequency depending on the ratio of liquid loss in chamber 3 during injection and compensation during refilling, i.e., charging. A valueless injector 1 is able to generate thin, high speed liquid jets, which can be utilized as the anode material for microfocus x-ray generation. The use of an injector 1 without moving parts such as valves increases the system reliability in comparison to tubes with rotating anodes or to liquid anode tubes with high pressure pumps. The injector 1 in accordance with the present invention is not sensitive to external acceleration, thus improving operational limits for different applications, for example, in computer tomography with fast rotating gantries.

The use of liquid metallic jets as the anode material allows the application of significantly higher loads to x-ray tubes compared with conventional microfocus solutions. The use of optimised combinations of different components of metallic alloys, for example, Lithium and Lanthanum, results in an optimised x-ray spectrum, which is essential for a high image quality and a low patient dose load during medical diagnostics.

Figure 4:
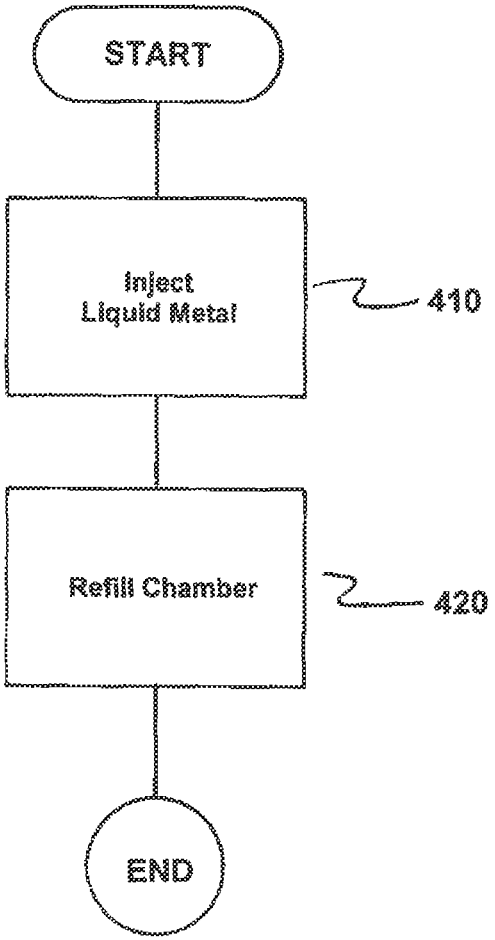
FIG. 4 is a flowchart of the method in accordance with the invention.

FIG. 4 is a flowchart of a method to provide a liquid anode (8) by liquid metal injection in an x-ray tube via a fluid injector (1). The method comprises injecting liquid metal as a fluid jet (8) from an opening (4, 10) of a chamber (3) formed by a device (2) to inject fluid in a direction towards an electron beam (15), as indicated in step 410. In accordance with the invention, an injection generated by changing a volume of the chamber (3) with an arrangement (5) produces a high pressure in the fluid in the chamber (3).

Next, the chamber (3) is refilled with liquid metal from a reservoir (6), as indicated in step 420. In accordance with the invention, the injected liquid metal flows from the reservoir (6) to the chamber (3) through a pipe (7).

While there have been shown, described and pointed out fundamental novel features of the invention as applied to a preferred embodiment thereof, it will be understood that various omissions and substitutions and changes in the form and details of the methods described and the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognised that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A fluid injector for x-ray tubes to provide a liquid anode by liquid metal injection, comprising:

a device which injects fluid from an opening in a chamber of the device as a fluid jet generated by an arrangement for changing a volume within the chamber;

a pipe connected to the chamber of the device; and a reservoir for storing the anode material, said reservoir being fluidically connected by the pipe with the chamber of the device;

wherein the pipe comprises a part formed in a fluid flow direction with a shape to block fluid flow from the chamber to the reservoir during injection.

2. The fluid injector according to claim 1, wherein the part is formed in the fluid flow direction with at least one of (i) a curved shape and (ii) an angled shape.

3. The fluid injector according to claim 2, wherein the part is formed as repeated loops of the pipe.

4. The fluid injector according to claim 3, wherein the as repeated loops of the pipe are spiraled.

5. The fluid injector according to claim 1, wherein the fluidic connection between the chamber and the reservoir is at least one of (i) an uninterrupted direct connection through the pipe and (ii) a permanent connection.

6. The fluid injector according to claim 2, wherein the fluidic connection between the chamber and the reservoir is at least one of (i) an uninterrupted direct connection through the pipe and (ii) a permanent connection.

7. The fluid injector according to claim 5, wherein the pipe comprises a part having a spiral shape with at least one of (i) a number of full loops in a range of 5 to 15, (ii) a predefined radius of curvature and cross-section to result in a limited and (iii) turbulent fluid flow in a direction toward the reservoir in a phase of injection and toward a laminar fluid flow in a direction to the chamber during a phase of refilling.

8. The fluid injector according to claim 1, wherein the fluid comprises a liquid metal.

9. The fluid injector according to claim 1, wherein the liquid metal is at least one of (i) Gallium, (ii) a Gallium alloy, (iii) Lithium and (iv) a Lithium alloy.

10. The fluid injector according to claim 1, wherein the device configured for high pressure pulsed fluid injection having an injection frequency in a range of 10 to 1000 Hz.

11. The fluid injector according to claim 1, wherein the arrangement comprises at least one of (i) a metal sheet, (ii) a membrane and (iii) a piezo element for a volume change within the chamber, with a frequency at least one of (i) in a range of 10 to 1000 Hz and (ii) to produce a high pressure within the chamber for pulsed fluid injection through the opening.

12. The fluid injector according to claim 1, wherein the device comprises at least one of (i) a nozzle cup having a sharp edge orifice, (ii) a clamped circular membrane and (iii) a piston driven by a piezo-actuator.

13. The fluid injector according to claim 1, wherein at least one of (i) the injector and (ii) components of the injector comprising the opening are arrangeable in or fluidically connectable to the inner part of a vacuum tube to inject fluid as anode material into at least one of (i) an electron beam generated by an electron source and (ii) to the electron beam generated by an electron source.

14. A method to provide a liquid anode by liquid metal injection in an x-ray tube via a fluid injector, the method comprising:

injecting liquid metal as a fluid jet from an opening of a chamber formed by a device to inject fluid in a direction towards an electron beam, an injection generated by changing a volume of the chamber with an arrangement producing a high pressure in the fluid in the chamber; and refilling the chamber with liquid metal from a reservoir, the injected liquid metal flowing from the reservoir to the chamber through a pipe.

15. The method according to claim 14, wherein the liquid metal flow in the pipe is laminar during refilling and at least partly turbulent during injection, liquid metal flow in the pipe being limited by a part of the pipe with at least one of (i) a curved and (ii) and angled shape in the flow direction during injection.

16. The method according to claim 15, wherein the part of the pipe is formed as repeated loops.

17. The method according to claim 16, wherein the repeated loops of the pipe are spiraled.

18. The method according to claim 14, wherein a pulsed liquid metal injection having a frequency of injection pulses in a range of 10 to 1000 Hz is subsequently followed by refilling the chamber with liquid metal from the reservoir comprising a metal liquidized by heating up solid metal in the reservoir.

19. The method according to claim 15, wherein a pulsed liquid metal injection having a frequency of injection pulses in a range of 10 to 1000 Hz is subsequently followed by refilling the chamber with liquid metal from the reservoir comprising a metal liquidized by heating up solid metal in the reservoir.

20. The method according to claim 14, wherein an electron beam converges the injected liquid metal jet comprising a pulsed liquid metal jet in an angle of substantially 90 degrees.

21. The method according to claim 20, wherein the electron beam converges the injected liquid metal jet, the liquid metal acting as at least one of (i) an anode material and a (ii) target, x-ray radiation being generated at least one of (i) at a high intensity level in a small volume of metal and (ii) with a low thermal load at the injected liquid metal.

22. The method according to claim 14, wherein during injection a piston driven by a piezo-actuator produces high pressure in the chamber by compressing a hydraulic fluid volume, deforming a membrane comprising a clamped circular membrane, to reduce the volume of the chamber with liquid metal being ejected from the chamber through an opening comprising a nozzle cup with sharp edge orifice, and liquid metal being blocked from flowing to the reservoir by a part of the pipe having at least one of (i) a curved shape and (ii) an angled shape.

* * * * *